United States Patent [19]

Wilcox

[11] Patent Number: 4,753,409

[45] Date of Patent: Jun. 28, 1988

[54] CHAIR SUPPORT INCORPORATING A HEIGHT ADJUSTMENT MECHANISM

[75] Inventor: Jeffrey S. Wilcox, East Grand Rapids, Mich.

[73] Assignee: Herman Miller, Inc., Zeeland, Mich.

[21] Appl. No.: 31,391

[22] Filed: Mar. 27, 1987

[51] Int. Cl.[4] ..... F16M 11/28; A47C 3/26

[52] U.S. Cl. ..... 248/409; 248/423; 248/578

[58] Field of Search ..... 248/409, 423, 578, 407, 248/408, 160; 297/338, 345, 437, 209

[56] References Cited

U.S. PATENT DOCUMENTS

| | | | |
|---|---|---|---|
| 316,281 | 4/1885 | Matthie . | |
| 499,671 | 6/1893 | Gard et al. . | |
| 1,121,698 | 12/1914 | Weiss . | |
| 1,327,611 | 1/1920 | Burns . | |
| 2,388,056 | 10/1945 | Hendricks . | |
| 2,780,277 | 2/1957 | Ries et al. . | |
| 3,390,855 | 7/1968 | Solin . | |
| 3,642,088 | 2/1972 | Smith | 248/408 X |
| 4,493,469 | 1/1985 | Holobaugh . | |

FOREIGN PATENT DOCUMENTS

| | | | |
|---|---|---|---|
| 960572 | 1/1975 | Canada | 248/408 |
| 1244351 | 7/1967 | Fed. Rep. of Germany | 297/345 |
| 2035950 | 2/1972 | Fed. Rep. of Germany | 248/407 |
| 2453105 | 5/1976 | Fed. Rep. of Germany | 248/407 |
| 1052825 | 9/1953 | France | 248/409 |
| 168984 | 9/1934 | Switzerland | 297/345 |
| 451122 | 7/1936 | United Kingdom | 248/408 |
| 2159403 | 12/1985 | United Kingdom | 297/345 |
| 2456361 | 7/1979 | U.S.S.R. . | |

*Primary Examiner*—Ramon S. Britts
*Assistant Examiner*—Karen J. Chotkowski
*Attorney, Agent, or Firm*—Varnum, Riddering, Schmidt & Howlett

[57] ABSTRACT

An adjustable chair support comprises an upstanding spindle and a tubular standard telescopically received on the spindle for vertical movement relative thereto. Stop means are provided for maintaining the vertical position of the standard relative to the spindle. Actuating means contained within the standard are operable to release the stop means and thus release the standard from one such vertical position for movement to another vertical position relative to the spindle. The actuating means, though enclosed within the standard, are operable from without the standard at an upper portion thereof.

10 Claims, 4 Drawing Sheets

CHAIR SUPPORT INCORPORATING A HEIGHT ADJUSTMENT MECHANISM

BACKGROUND OF THE INVENTION

This invention relates to an adjustable support, and more particularly, to a support for a chair or stool which is adjustable to vary the height of the seat thereof.

For a number of years a pneumatically-operated piston-and-cylinder unit has been employed in many chairs of the pedestal type, serving both as the load-bearing member between the base and the seat of the chair and as a means for adjusting the height of the seat relative to the base in response to manual actuation of a lever or handle located directly beneath the seat so that it is readily accessible to an occupant of the chair.

In such supports, the magnitude of the internal pneumatic pressure is so selected that when the handle is actuated and the seat is occupied, the weight of the occupant acts to reduce the height of the pneumatic unit and thus of the seat. When the handle is actuated and the seat is unoccupied, the height is increased as a result of the action of the virtually unopposed pneumatic pressure.

Such units are not only easily operated, they are comfortable in operation because of the buffering effect of the compressed gas which provides the pneumatic pressure. However, they are relatively expensive, and no matter how well they are made, wear and aging of the pneumatic seals sooner or later permits the gas to escape, and eventually the unit or the chair itself must be replaced.

The present invention is intended to provide a mechanical, as opposed to pneumatic, substitute or replacement for such a unit at lower cost but with the same ease of operation, similar comfort, and substantially identical exterior configuration.

Supports which may be selectively fixed at various predetermined heights have long been known. An early example is the piano stool disclosed in U.S. Pat. No. 316,281, issued Apr. 21, 1885, to W. A. C. Matthie. Here the seat of the stool is supported on a vertically extending spindle. Formed in the outer surface of the spindle are a number of annular recesses in parallel, vertically spaced relation to each other. A tubular base or stand telescopically receives the lower end of the spindle. Also contained within the stand is a spring biasing the spindle upwardly relative to the stand. Detent means supported on the stand are receivable in any one of the recesses to lock the spindle in a respective one of a plurality of vertical positions relative to the stand. Actuating means are operable to withdraw the detent means from one of the recesses to permit movement of the spindle vertically relative to the stand. The actuating means extends laterally outwardly from the stand at a fixed height, whereby the distance from the seat to the actuating means is variable.

Also representative of the prior art is the stool disclosed in U.S. Pat. No. 2,780,277, issued Feb. 5, 1957, to E. J. Ries et al. Here, too, the seat of the stool is supported on a vertically extending spindle in the outer surface of which are formed a plurality of annular recesses in parallel vertically spaced relation. Again, the spindle is telescopically received in a tubular base. A locking device comprises a collar rigidly secured to the upper end of the support and detent means pivotally mounted in the collar to be received in one of the recesses, whereby to lock the spindle in a respective vertical position relative to the support. In this instance, the detent actuating means is operated by means of a release bar disposed at the lower end of the support for engagement by the foot of the occupant of the seat, thereby freeing his hands.

SUMMARY OF THE INVENTION

The adjustable support according to the present invention comprises a vertically extending spindle having a plurality of annular recesses formed in the outer surface thereof in parallel vertically spaced relation to each other. A tubular standard is telescopically received at its lower end over the upper end of the spindle. Means are provided to bias the standard upwardly relative to the spindle, and detent means carried by the standard are receivable in any one of the recesses to lock the standard in a respective one of a plurality of vertical positions relative to the spindle corresponding to the recesses. As in the prior art, actuating means are operable to withdraw the detent means from the recess in which they are received, thereby permitting movement of the standard vertically relative to the spindle.

However, the actuating means is enclosed within the standard. It comprises essentially an actuating rod having a lower end portion thereof in engagement with the detent means and extending upwardly therefrom and axially within the standard. The actuating rod has an upper end portion engageable from the exterior of the standard to depress the actuating rod relative to the standard and thereby withdraw the detent means from the recess in which it has been received.

Other objects, features and advantages of the invention will be apparent from the ensuing description in conjunction with the accompanying drawings.

THE DRAWINGS

THE PREFERRED EMBODIMENT

Figure 1A:
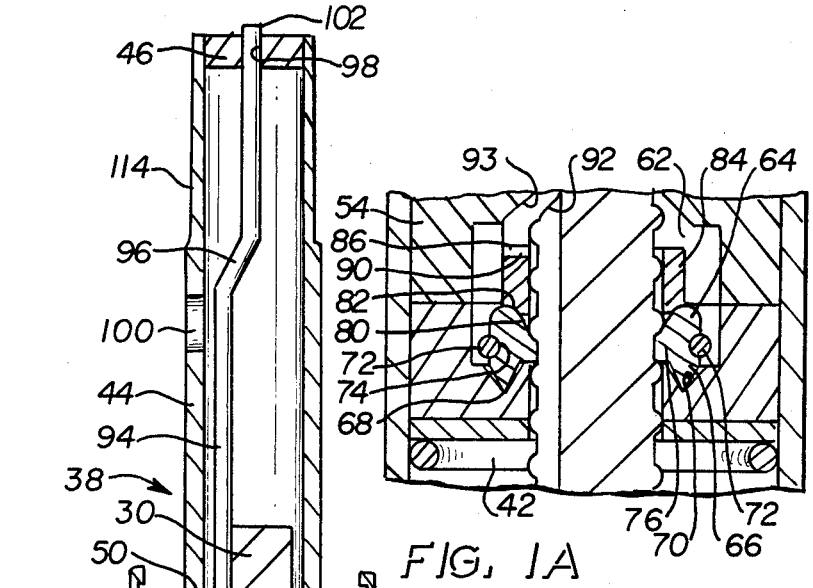
FIG. 1A is a greatly enlarged fragmentary view of a portion of the longitudinal section of FIG. 1 depicting the stop means of the support and elements associated with the stop means.
Figure 1:
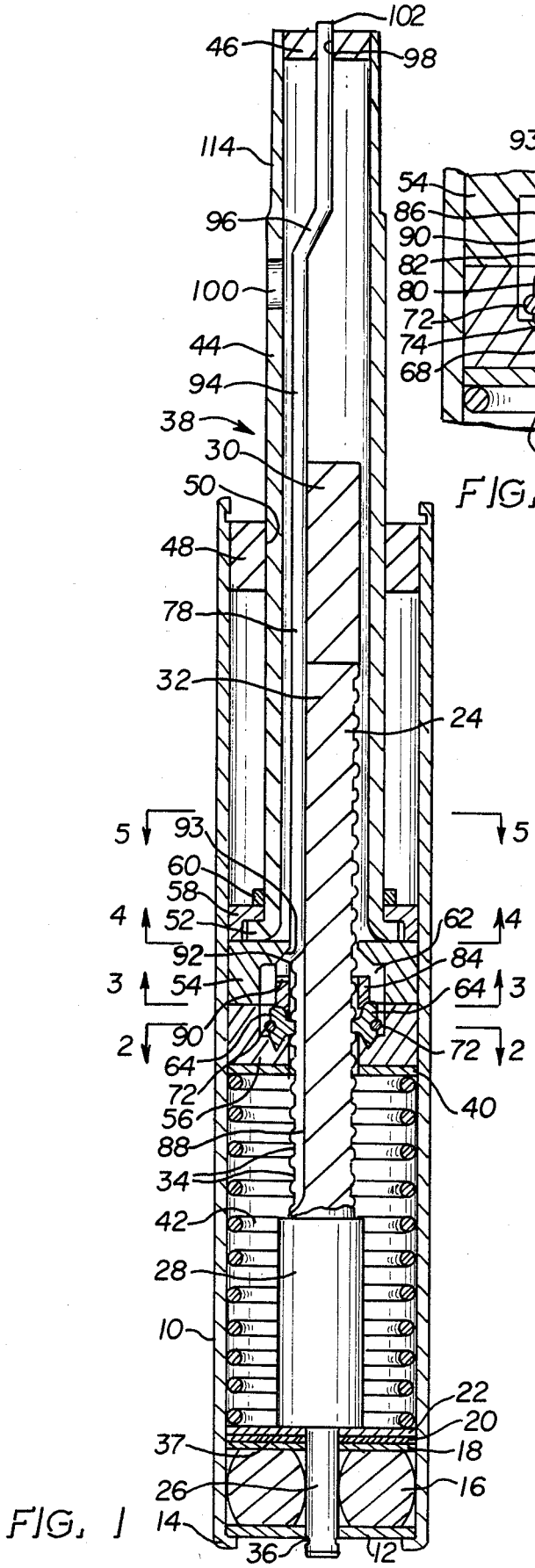
FIG. 1 is an elevational view, partly in longitudinal section, of an adjustable support comprising a preferred embodiment of the invention.

Referring initially to the lower portion, as shown in FIG. 1, of a preferred embodiment of an adjustable support according to the invention, a tubular housing 10 encloses much of the structure and conceals it from view. (The housing is preferably formed of a suitable grade of steel, as are other elements of the structure except where noted hereinafter.) Housing 10 is closed at its lower end by a washer 12 supported on an in-turned lower flange 14 of the housing. A toroidal lower cushion or bumper 16, suitably formed of a resilient synthetic resinous material, is supported on washer 12. Supported, in turn, on the lower bumper is a sandwich-like series of washers 18, 20 and 22, of which lower and upper washers 18 and 22 are preferably formed of steel, the intermediate washer 20 preferably being formed of a lubricating resinous material such as that marketed under the trademark Teflon.

Supported by the elements of the structure heretofore described is a unitary, solid, cylindrical spindle 24 formed with a lower post 26, which extends downwardly from a base portion 28 of enlarged diameter, and an upper end portion 30 having a smooth outer cylindrical surface.

An intermediate locking portion 32 of the spindle is disposed between base portion 28 and upper end portion 30. Locking portion 32 is distinguished by a plurality of annular recesses 34 formed in its outer surface in parallel vertically spaced relation to each other. The upper and lower margins of each recess are rounded for a purpose which will be apparent from the ensuing description.

Washers 12, 18, 20 and 22 and lower bumper 16 are apertured at their centers to receive lower post 26 of spindle 24 with its lower end protruding from the support and there secured in well-known manner by means of a locking ring (not shown) received in an annular groove 36 formed on the protruding end of post 26. As a result of the enlarged diameter of the spindle base portion 28 relative to the diameter of lower post 26, a shoulder 37 is provided on spindle 24, the shoulder engaging the upper surface of washer 22, whereby spindle 24 is supported in an upstanding position within and coaxial with housing 10.

A tubular standard 38 is telescopically received at its lower end over the upper end of spindle 24. Standard 38 is supported on a washer 40, preferably formed of steel. Washer 40 is supported on a coil spring 42 which is, in turn, supported on washer 22. The coil spring is shown in a state of compression whereby it will be understood that it will act to bias standard 38 upwardly relative to spindle 24 throughout the range of vertical movement intended for standard 38.

Standard 38 is an assembly the upper portion of which comprises a hollow shaft 44 closed at its upper end by a cap 46, preferably formed of a synthetic resinous material. Similarly, housing 10 is closed at its upper end by a standard guide 48, preferably formed of a suitable sintered metal, and provided with a guide aperture 50 extending therethrough from the interior of housing 10 to the exterior. Standard 38 is telescopically received at its lower end within and at the upper end of housing 10, shaft 44 being received in guide aperture 50 to be laterally supported by guide 48 for vertical sliding movement relative to the housing.

Figure 4:
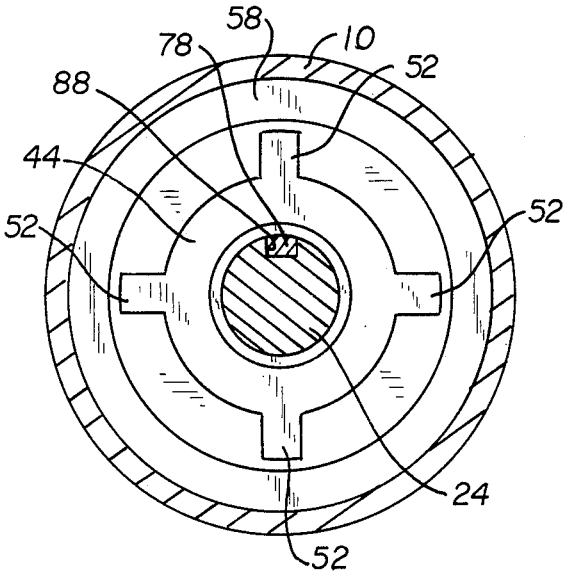
FIG. 4 is a view similar to those of FIGS. 2 and 3 but taken along the line 4—4 of FIG. 1.
Figure 5:
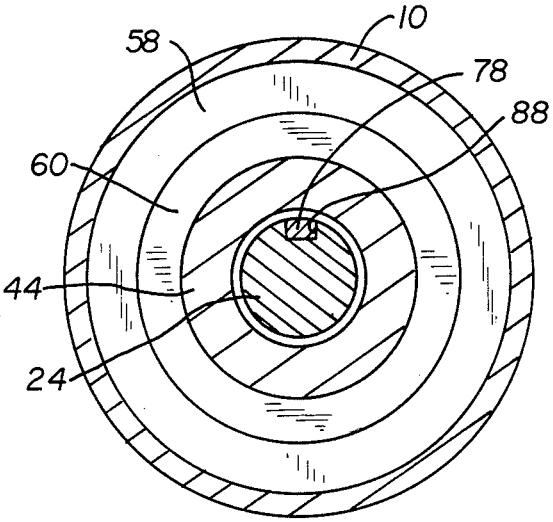
FIG. 5 is a view similar to those of FIGS. 2, 3 and 4 but taken along the line 5—5 of FIG. 1.

Shaft 44 has at its lower end a plurality of out-turned feet 52 best seen in FIG. 4, by which it is supported on the upper surface of an upper retainer ring 54, which in turn rests on a lower retainer ring 56 supported on washer 40, the retainer rings completing the lower end of the assembly which comprises standard 38.

Feet 52 of hollow shaft 44 are enclosed by an annular bushing support 58 supported at its lower edge on upper retainer ring 54. Supported on the upper surface of bushing support 58 is an upper bumper 60, preferably formed of resilient polyurethane and positioned to engage the lower surface of guide 48 to cushion any shock which might result from standard 38 reaching the upper limit of its travel imposed by such engagement. A similar function is performed by lower bumper 16 when spindle 24 is subjected to downwardly directed forces or impacts.

Figure 2:
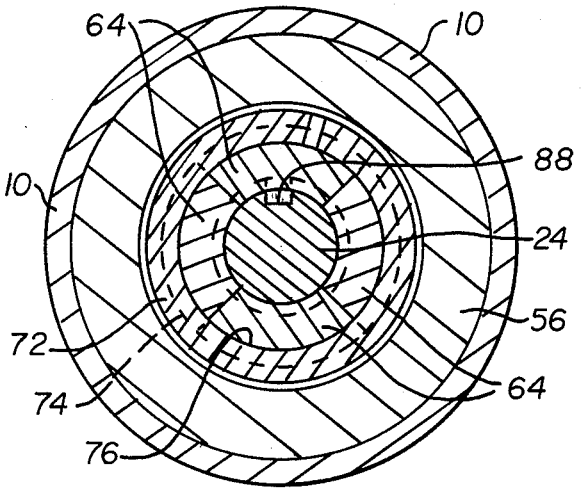
FIG. 2 is an enlarged cross-sectional view of the support of FIG. 1 taken along the line 2—2 thereof.
Figure 3:
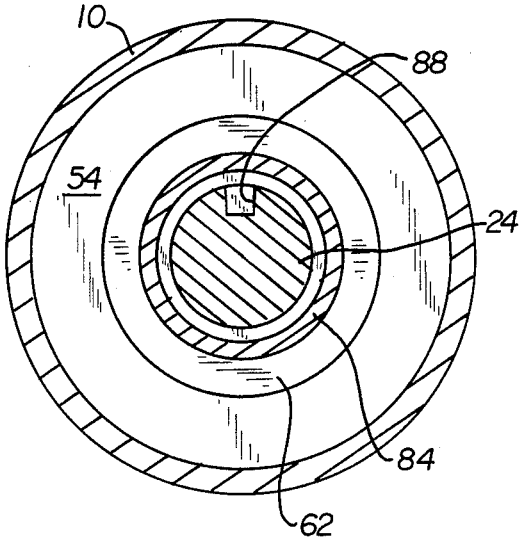
FIG. 3 is a view similar to that of FIG. 2 but taken along the line 3—3 of FIG. 1.
Figure 6:
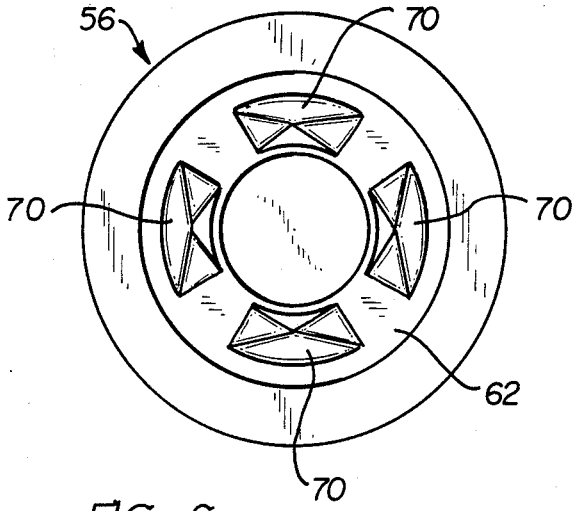
FIG. 6 is a top plan view of an element shown in section in FIG. 1.
Figure 7:
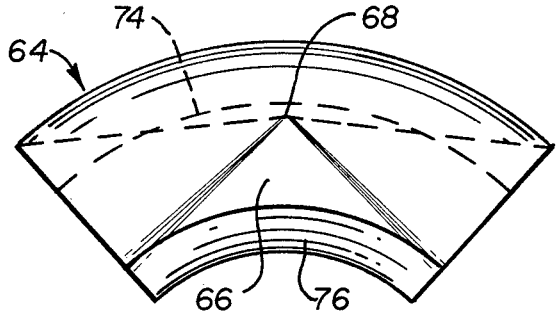
FIG. 7 is a bottom plan view of another element shown in section in FIG. 1.
Figure 8:
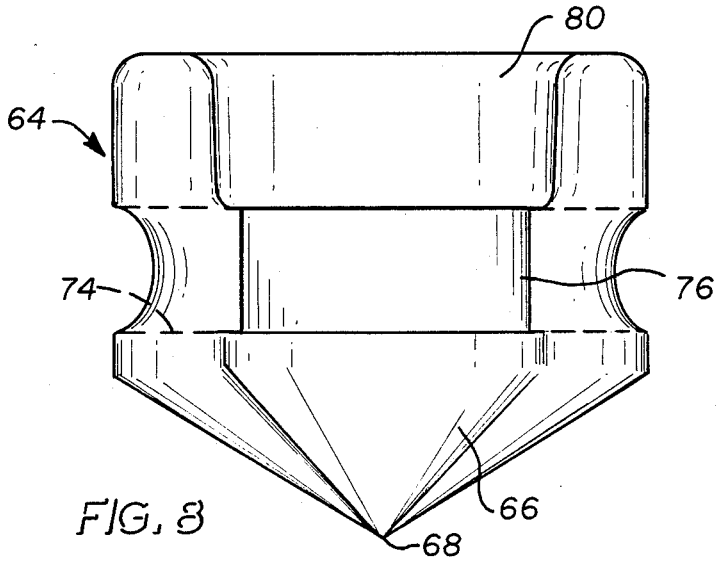
FIG. 8 is a radially inner, elevational view of the element shown in FIG. 7.

Retainer rings 54 and 56 are so formed at their radially inner surfaces that they cooperate to define an annular cavity 62 in which are carried stop means comprising a plurality of stop members arranged about spindle 24, each stop member having a wedge-shaped lower portion 66 (FIG. 8) tapering downwardly and inwardly to a lowermost point 68. Lower retainer ring 56 is formed with a plurality of sockets 70 (FIGS. 1A and 6) which open upwardly and are of prismatic configuration similar to that of the wedge-shaped portions 66. However, sockets 70 are so dimensioned that they receive wedge-shaped portions 66 loosely, thereby permitting angular movement of each stop member inwardly toward and outwardly away from a locking position adjacent to spindle 24; that is, the position shown in FIGS. 1, 1A and 2. (It will also be noted in FIG. 2 that the stop members cooperate to define an annulus surrounding spindle 24.) The stop members are embraced by an annular spring 72, interrupted as shown in FIG. 2, which acts to bias them inwardly toward the locking position. The annular spring is received in a groove 74 provided in the radially outer surface of each stop member 64.

Each stop member is also provided with an annular detent 76 extending inwardly from its radially inner surface and configured to be received snugly within any one of annular recesses 34.

The stop members comprise elements of an actuating system for withdrawing detents 76 from a recess 34 in which they are received, the actuating system also including an actuating rod 78 and cam means 80, 82, 84 and 86. More particularly, the cam means comprises an upper cam surface 80 provided on each stop member 64 and inclining away from spindle 24; that is, it is inclined generally outwardly and upwardly from the spindle when the respective stop member is in the locking position, and a lower cam surface 82 provided on an annular cam member 84 surrounding spindle 24 and supported on stop members 64. The lower cam surface is formed to engage upper cam surface 80 of each of the stop members and is generally complementary thereto. Cam member 84 is also provided with an annular horizontal upper surface 86.

Spindle 24 is provided with a slot 88 which interrupts its outer surface and extends vertically downwardly from the upper end of the spindle to intersect all the annular recesses 34, the slot being open at its upper end to receive actuating rod 78 in sliding engagement with the spindle. The lower end 90 of the actuating rod engages upper surface 86 of cam member 84, being provided with a lower offset 92 so that lower end 90 will be positioned outwardly of slot 88. A shoulder 93 is provided on upper retainer ring 54 to be engaged by lower offset 92, whereby to limit the movement of rod 78 relative to standard 38 in the upward direction. Extension 94 of the actuating rod is also provided with an upper offset 96 so that it may be received in a central aperture 98 provided in cap 46. Aperture 98 extends through the cap from the interior of hollow shaft 44 to the exterior and supports rod extension 94 for reciprocable sliding movement relative to the cap and thereby to standard 38. It will be understood, however, that rod 78, stop member 64 and cam member 84 are carried by standard 38 for vertical movement therewith.

It is to be noted in FIGS. 2, 3, 4 and 5 that actuating rod 78, and slot 88 in which the rod is received, are generally rectangular in transverse or cross section.

Rod extension 94 is accessible from without standard 38, either by way of aperture 98 or by way of an aperture 100 formed in hollow shaft 44. In either case, an upper end portion 102 of actuating rod 78, or more precisely, its extension 94, normally protrudes from the upper end of standard 38, whereby it may be engaged from the exterior of the standard.

It will be noted from the foregoing description and the accompanying drawings that the structure of the adjustable support of the invention is compact, easily assembled and attractive, the actuating system being largely hidden from view by housing 10 and hollow shaft 44, while being readily accessible from an upper part of the structure.

Figure 9:
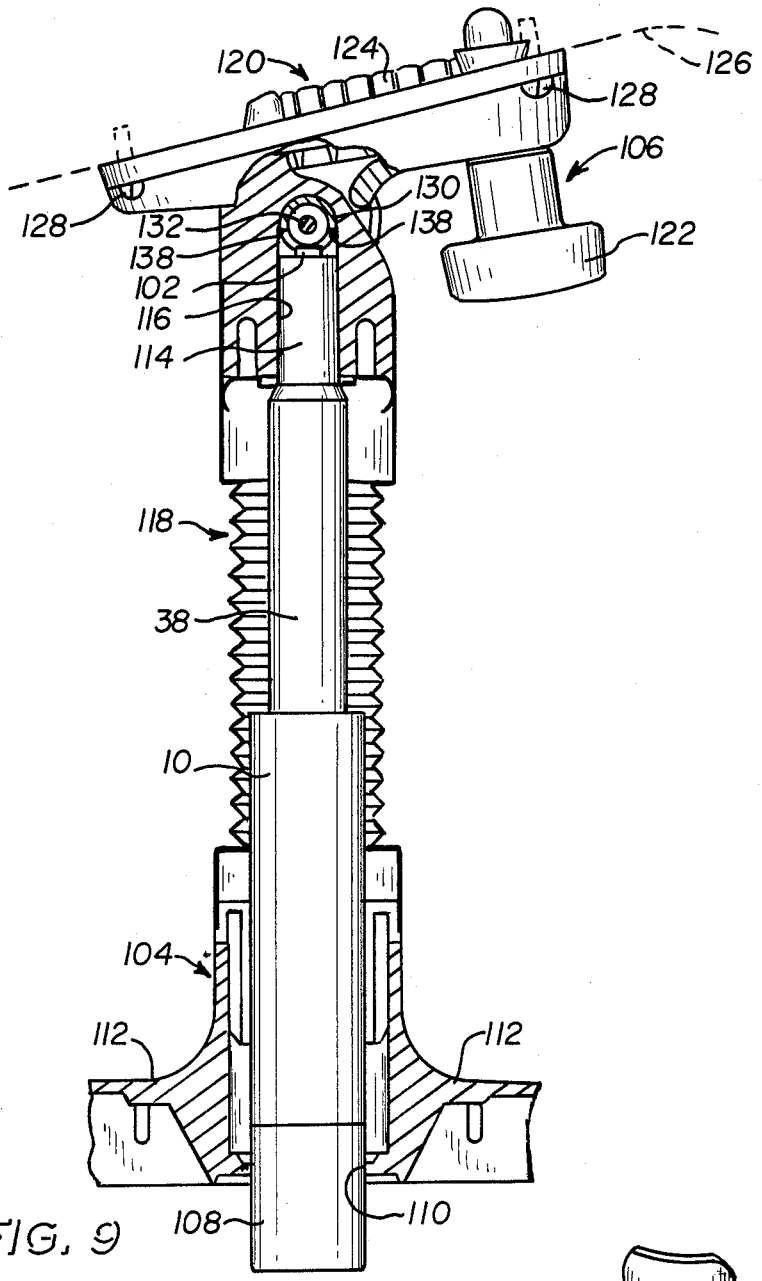
FIG. 9 is a fragmentary elevational view, partially in section, showing portions of a chair incorporating the adjustable support of FIGS. 1, 1A, and 2 to 8.

Turning now to FIG. 9, the adjustable support of the invention is shown incorporated in a known chair having a base member 104 and a seat assembly 106. The outer configuration of the adjustable support, and more particularly, of housing 10 thereof, is modified somewhat from the configuration shown in FIG. 1 in that a lower portion 108 of housing 10 is provided with a slight taper downwardly so that it may be press-fitted in a complementary socket 110 of base member 104. The base member is provided with laterally extending arms, two of which are shown fragmentarily at 112, and which are provided at their ends (not shown) with supporting casters (also not shown). An upper end portion 114 of frusto-conical form is press-fitted in a complimentary socket 116 provided in seat assembly 106. A bellows assembly 118 may be provided as a dust barrier and aesthetic feature. A tilt assembly 120 includes a knob 122 and a spring 124 for adjusting the stiffness of the seat in resisting tilting forces about a horizontal axis extending outwardly toward the viewer from the plane of FIG. 9.

A seat 126, indicated in part by interrupted lines is incorporated in seat assembly 106 by means of bolts 128.

Figure 11:
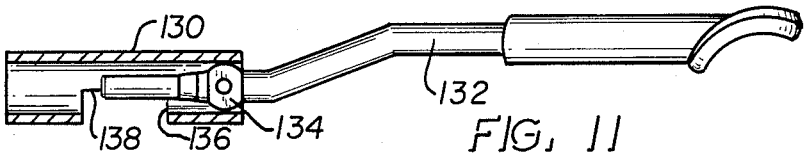
FIG. 11 is an elevational view of the handle of FIG. 10 including a partial sectional view taken along the line 11—11 of FIG. 10.

An actuator 130 is rotatably received in seat assembly 106 and is disposed in socket 116 above standard 38. A handle 132 is connected with actuator 130 by means of a ball and pin arrangement 134 (FIG. 11) to permit some play in manual actuation of the handle.

Actuator 130 is cylindrical in form and is provided with an aperture 136 in which upper end portion 102 of actuating rod 78 (FIG. 1) is received, the aperture being bounded in the circumferential direction by a pair of parallel axially extending edges 138.

Referring to FIG. 9, handle 132 extends longitudinally toward the viewer from the plane of the drawing and is disposed directly beneath seat 126 for ready access by an occupant of the seat.

OPERATION

Figure 10:
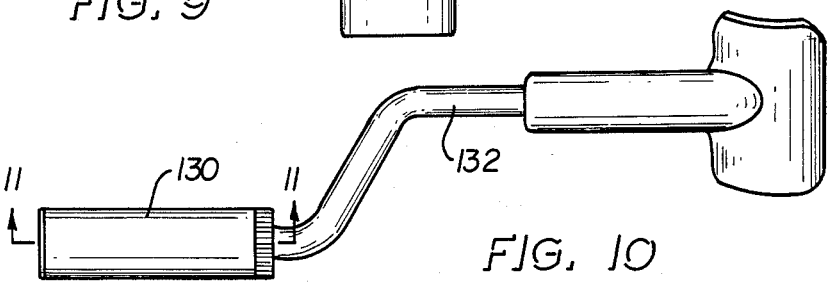
FIG. 10 is a plan view of an actuating handle provided in the chair of FIG. 9.

When detents 76 are received in one of annular recesses 34, as represented in FIGS. 1 and 1A, standard 38 will be held in one vertical position relative to spindle 24. If the height of seat 126 (FIG. 10) is to be adjusted from the vertical position shown, a downward force may be exerted on actuating rod extension 94 by manually rotating handle 132 and thus actuator 130 in either direction to cause one of the edges 138 to depress upper end portion 102 of actuating rod 78. This will cause the actuating rod to slide downwardly relative to spindle 24 within slot 88. The rod will transmit the manually exerted force by way of its lower end 90 to upper surface 86 of cam member 84 to urge the latter downwardly. Such movement will cause lower cam surface 82 of the cam member to exert a radially outward force on upper cam surface 80 of each stop member 64, causing the stop members to move angularly outwardly from the locking position shown in the drawing about the pivots provided by their lowermost points 68 and against the tension of annular spring 72. Such angular movement of the stop members causes their detents 76 to be withdrawn from the annular recess in which they have been received, thereby freeing standard 38 for movement vertically relative to spindle 24, movement facilitated by the rounded margins of the recesses. Coil spring 42 is selected so that when the standard is released to move vertically relative to the spindle, the spring will exert a force great enough to urge the standard upwardly against the weight of the structure it supports, unless an external force is applied to the standard downwardly with sufficient magnitude to overcome the upward force exerted by the spring. Such external force might be the weight of a person occupying the seat supported by standard 38.

As soon as standard 38 has begun to move vertically, the actuating force on rod extension 94 may be released by releasing handle 132, whereby annular spring 72 will act to urge stop members 64 angularly toward the spindle, and detents 76 will be received in the first annular recess 34 they next encounter, whereby to lock the standard, and thus the seat, in respective vertical positions relative to the spindle different from those respective positions from which they were just released. This action of annular spring 72 also urges actuating rod 78 upwardly to cause its upper end portion 102 to return handle 132 to a neutral position by acting on that edge 138 of actuator 130 in engagement with end portion 102.

It should be noted that in addition to the relative vertical movement heretofore described, the elements of the preferred embodiment of the invention are so constructed that, with appropriate lubrication, the standard 38 will be freely rotatable relative to spindle 24 and housing 10 to provide a swivel function.

While the invention has been particularly described in connection with a certain specific embodiment thereof, it is to be understood that this is by way of illustration and not of limitation, and the scope of the appended claims should be construed as broadly as the prior art will permit.

What is claimed is:

1. In an adjustable support comprising an upstanding spindle having a plurality of annular recesses formed in the outer surface thereof in parallel vertically spaced relation to each other, a tubular standard telescopically received at its lower portion over the upper end of the spindle and adapted to receive application of an external downward force, means biasing the standard upwardly relative to the spindle, detent means carried by the standard and receivable in any one of the recesses to lock the standard in a respective one of a plurality of vertical positions relative to the spindle corresponding to the recesses, and actuating means operable to withdraw the detent means from said one recess, thereby permitting movement of the standard vertically relative to the spindle, the improvement wherein the actuating means comprises an actuating rod having a lower end portion thereof in engagement with the detent means and extending upwardly therefrom and axially within the standard, the actuating rod having an upper end portion engageable from the exterior of the standard to depress the actuating rod relative to the standard and thereby withdrawn the detent means from said one recess, the biasing means being so selected that upon withdrawal of the detent means from said one recess the standard will be moved downwardly relative to the spindle against the urging of the biasing means by application of an external force of predetermined magnitude.

2. In an adjustable support according to claim 1, the further improvement wherein the detent means comprises stop means suported within the standard at the lower portion thereof for angular movement relative thereto inwardly toward and outwardly away from a locking position adjacent to the spindle, at least one detent extending inwardly form the stop means to be received in one of the recesses when the stop means is in the locking position, means biasing the stop means inwardly toward the locking position, and cam means interposed between the stop means and the lower end portion of the actuating rod, the cam means being adapted to transmit a force exerted downwardly upon the actuating rod at the upper end portion thereof to the stop means in a direction to move the stop means angularly away from the locking position, thereby withdrawing said detent from said one annular recess to free the standard for vertical movement relative to the spindle.

3. In an adjustable support according to claim 2, the further improvement wherein the stop means comprises at least one stop member having wedge-shaped lower protion tapering downwardly and inwardly to a lowermost point, the stop member being supported on the point to establish a pivot for said angular movement, an upper cam surface being provided on the stop member and inclining away from the spindle, the cam means comprising a cam member supported on the stop member adjacent to the spindle and having a lower cam surface in engagement with the upper cam surface of the stop member.

4. In an adjustable support according to claim 2, the further improvement wherein the stop means comprises a plurality of stop members disposed about the spindle, each stop member having a wedged-shaped lower portion tapering downwardly and inwardly to a lowermost point, each stop member being supported on the respective point to establish a pivot for said angular movement, the inwardly biasing means comprising an annular spring embracing the stop members outwardly thereof, an upper cam surface being provided on each of the stop members and inclined generally outwardly and upwardly away from the spindle, the cam means comprising an annular cam member surrounding the spindle and having a lower cam surface in engagement with the upper cam surface of each of the stop members.

5. In an adjustable support according to claim 4, the further improvement wherein the cam member is provided with a horizontal upper surface opposite from the lower cam surface and engaged by the lower end of the actuating rod.

6. In an adjustable support according to claim 1, the further improvement wherein the spindle is provided with a slot interrupting its outer surface and extending vertically downwardly from the upper end of the spindle to intersect each of the annular recesses, the slot being open at its upper end to receive the actuating rod in sliding engagement with the spindle.

7. In an adjustable support according to claim 6, the further improvement wherein the actuating rod is generally rectangular in cross section and the transverse configuration of the slot is complementary to that of the rod.

8. In an adjustable support according to claim 1, the further improvement wherein the standard includes a cap closing its upper end, means defining an aperture extending through the cap from the interior of the standard to the exterior of the support, the upper end portion of the actuating rod being received in the aperture for reciprocable sliding movement relative to the cap and thereby to the standard.

9. In an adjustable support according to claim 1, the further improvement comprising a tubular housing supporting the spindle therewithin at the lower ends of the housing and of the spindle, the housing enclosing the means biasing the standard upwardly, the standard being telescopically received at its lower portion within and at the upper portion of the housing and being supported by the upwardly biasing means, a standard guide closing the housing at its upper end, means defining an aperture extending through the standard guide from the interior of the housing to the exterior of the support, the standard being received in the aperture to be laterally supported by the guide for vertical sliding movement relative to the housing.

10. A chair comprising a base member, a seat assembly, and an adjustable support interconnecting the base member and the seat assembly, the seat assembly including a seat, and handle means having a rotatable handle extending beneath and adjacent to the seat, whereby the handle is manually accessible to an occupant of the seat, and an actuator connected to the handle and rotatable therewith, the adjustable support being adapted to be disassembled as a unit from the base member and the seat assembly and including an upstanding tubular housing supported on the base member, an upstanding spindle supported coaxially within the housing and having a plurality of annular recesses formed in the outer surface thereof in parallel vertically spaced relation to each other, a tubular standard telescopically received at its lower portion over the upper end of the spindle and within the upper portion of the housing, the seat assembly being supported on the standard at the upper portion thereof, means enclosed within the housing biasing the standard upwardly relative to the spindle, detent means carried by the standard and receivable in any one of the recesses to lock the standard in a respective one of a plurality of vertical positions relative to the spindle corresponding to the recesses, and an actuating rod having a lower end portion thereof in engagement with the detent means and extending upwardly therefrom and axially within the standard, the actuating rod having an upper end portion protruding upwardly and outwardly from the upper end of the standard in a position to be engaged by the actuator to depress the actuating rod relative to the standard when the actuator is rotated, whereby to withdraw the detent means from said one recess and permit movement of the standard vertically relative to the spindle.

* * * * *